US005613817A

United States Patent [19]

Bush et al.

[11] Patent Number: 5,613,817

[45] Date of Patent: Mar. 25, 1997

[54] PLASTIC TACK STRIP WITH INTERLOCK

[75] Inventors: E. Dan Bush, Downers Grove; David Wortner, Northlake, both of Ill.

[73] Assignee: Handy Button Machine Company, Melrose Park, Ill.

[21] Appl. No.: 401,076

[22] Filed: Mar. 8, 1995

[51] Int. Cl.[6] ..... F16B 15/00

[52] U.S. Cl. ..... 411/466; 411/469

[58] Field of Search ..... 411/457, 461, 411/466, 469, 520, 903, 921; 16/16; 403/329

[56] References Cited

U.S. PATENT DOCUMENTS

| | | | |
|---|---|---|---|
| 1,576,490 | 3/1926 | Randall | 411/461 |
| 2,142,167 | 1/1939 | Zalkind | 411/461 |
| 2,668,584 | 2/1954 | Greitzer | 403/329 |
| 2,968,072 | 1/1961 | Bright | 411/921 |
| 3,927,443 | 12/1975 | Brumlik | 411/466 |
| 4,431,331 | 2/1984 | Brody | 403/329 |
| 4,853,067 | 8/1989 | Annas, Sr. et al. . | |
| 5,031,266 | 7/1991 | Tillman | 403/329 |
| 5,098,243 | 3/1992 | Buck | 411/457 |
| 5,479,675 | 1/1996 | Pytlewski | 403/329 |

FOREIGN PATENT DOCUMENTS

| | | | |
|---|---|---|---|
| 684957 | 12/1952 | United Kingdom . | |
| 2119240 | 3/1983 | United Kingdom . | |
| 2221838 | 2/1990 | United Kingdom | 16/16 |

*Primary Examiner*—Steven N. Meyers
*Assistant Examiner*—Gary Estremsky
*Attorney, Agent, or Firm*—Trexler, Bushnell, Giangiorgi & Blackstone, Ltd.

[57] ABSTRACT

A tack strip assembly for use in securing upholstery fabric to furniture or the like includes an elongate metal tack strip and an elongate protective vinyl or other suitable plastic sleeve which generally surrounds the tack strip. The tack strip has a base portion and a plurality of integrally formed, spaced tacks which extend outwardly from the base portion and a plurality of spaced apertures in the base portion. The sleeve has a bottom portion which generally overlays a bottom surface of the base portion and portions which overlay the side edges and portions of the top surface of the base portion. The sleeve has a tab or a plurality of tabs formed in its bottom surface, each of which extends into an aperture in the base portion to restrain relative endwise movement between the sleeve and the base portion and to minimize the possibility of the sleeve from detaching from the tack strip.

15 Claims, 3 Drawing Sheets

PLASTIC TACK STRIP WITH INTERLOCK

BACKGROUND OF THE INVENTION

This invention is generally directed to new and useful improvements in tack strips which are used to assemble upholstered furniture. More particularly, the invention contemplates a novel interlocking means between a tack strip and a protective sleeve to restrain relative endwise movement between the tack strip and the protective sleeve and minimize the possibility of the protective sleeve from disengaging from the tack strip.

Tack strips are commonly used to secure the fabric covering of upholstered furniture. In some situations, it is necessary to position the upholstery fabric such that the fabric abuts an edge portion of the tack strip.

Tack strips are usually stamped out of a metal material. In the manufacture of a tack strip, small, sharp metal burrs are often produced by the stamping process which can be found at the edge portions or ends of the strip. The burrs can snag the upholstery fabric or injure operators. Even when the edges and ends of the metal strip are completely burr-free, since the tack strip is covered only with thin upholstery fabric, working of the metal during installation or shipment can cause tearing or undesirable "shine-through." To prevent or minimize the possibility of such damage, tack strips are commonly enclosed within a protective vinyl or other suitable plastic sleeve to protect or insulate the metal strip within the sleeve. The sleeve overhangs both ends and the edge portions of the tack strip to protect the upholstery fabric and the operator's fingers from the sharp metal burrs.

The metal tack strip is inserted into the protective sleeve by a supplier manually, and drops of hot melt glue are applied to prevent the sleeve from slipping off of the tack strip prior to use. Application of hot melt glue is a labor intensive method and therefore a costly method of attempting to prevent the vinyl strip from shifting or disengaging from the tack strip. Moreover, handling each strip to apply hot melt glue is laborious and costly.

Not all sleeves, however, are glued in place, and the sleeve sometimes slides off. If this happens, the protective sleeve is useless and is more costly for the user if the sleeve needs to be manually reapplied or centered one at a time.

While the application of a hot melt glue is usually satisfactory for preventing the protective sleeve from slipping off or disengaging from the tack strip, the labor required to apply the hot melt glue increases the cost of manufacture of the tack strip. This labor must be paid for either by the supplier or the customer.

The present invention presents a novel improvement to tack strips which eliminates the need to manually and laboriously apply hot melt glue or any other type of adhesive to secure the protective sleeve to the tack strip. The present invention also presents several other novel features and advantages.

OBJECTS AND SUMMARY OF THE INVENTION

A general object of the present invention is to provide a novel improvement for interlocking a tack strip and a protective sleeve together.

An object of the present invention is to provide a novel interlocking means between a protective sleeve and a tack strip to restrain relative endwise movement between the tack strip and the sleeve and to prevent or minimize the possibility of the sleeve slipping off of or disengaging from the tack strip.

Another object of the present invention is to provide an interlocked protective sleeve and tack strip which are less costly to manufacture than prior art tack strips and sleeves which use common methods of manufacture such as manually and laboriously applying drops of hot melt glue between the strip and sleeve to interlock such components together.

Briefly, and in accordance with the foregoing, the present invention discloses a tack strip assembly for use in securing upholstery fabric to furniture or the like. The assembly includes a metal tack strip and a protective sleeve which generally surrounds the tack strip. The sleeve is made of vinyl or other suitable plastic and the like.

The tack strip is formed from an elongate metal base portion which has an upper surface, a lower surface, opposite ends, side edges and a plurality of integrally formed, spaced tacks of a predetermined height which extend outwardly from the base portion and are aligned generally along a centerline of the base portion. The tacks define apertures in the base portion which are formed in the base portion when the tacks are formed. Thus, the length of each aperture corresponds to the height of the tack.

The sleeve includes a bottom portion which generally overlays the bottom surface of the base portion, side portions which overlay the side edges of the base portion and top portions which overlay portions of the top surface of the base portion. The sleeve includes novel interlocking means which interlock with the apertures in the base portion. The novel interlocking means includes a single or a plurality of tabs in the sleeve's bottom surface. Each tab extends into an aperture in the base portion to minimize the relative endwise movement between the sleeve and the base portion.

In a first embodiment of the interlocking means, as shown in FIGS. 2 and 2A, each tab has a first end which is integral with the bottom portion of the sleeve and a second end which is free and extends into the aperture. The first, free end of each tab is proximate to the tack. In a second embodiment of the interlocking means, as shown in FIGS. 3 and 3A, each tab has a first end which is integral with the bottom portion of the sleeve and a second end which is free and extends into the aperture. The second, free end of each tab is proximate to the tack. In a third embodiment of the interlocking means, as shown in FIGS. 4 and 4A, the tab has a middle portion which is integral with the bottom surface of the sleeve and first and second free ends which extend from the middle portion and into the aperture.

In a fourth, fifth and sixth embodiments of the interlocking means, as shown in FIGS. 5 and 5A, 6 and 6A, 7 and 7A, respectively, each tab is formed by deforming a portion of the bottom surface of the sleeve. Each deformed portion extends into an aperture in the base portion. Each deformed portion has ends which are integral with the bottom surface of the sleeve.

Alternatively, the apertures can be provided in the bottom surface of the sleeve and the tabs can be formed in the base portion.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
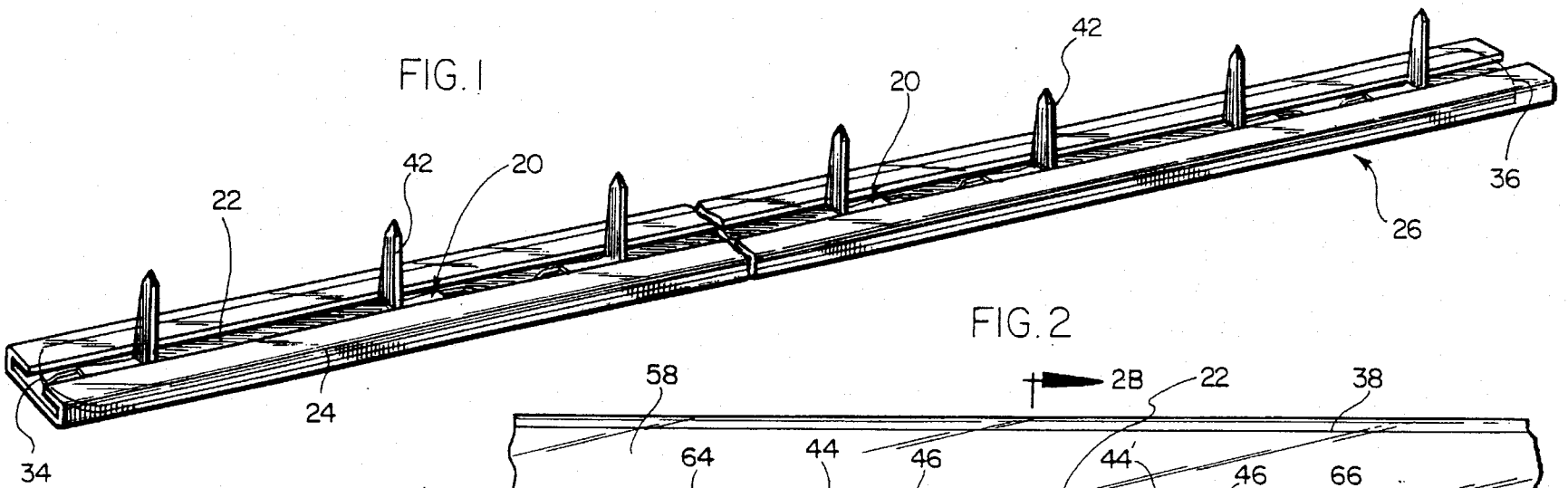
FIG. 1 is a perspective view of a tack strip assembly which includes a tack strip and an interlocked plastic sleeve which incorporates the features of a first embodiment of the invention.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 2:
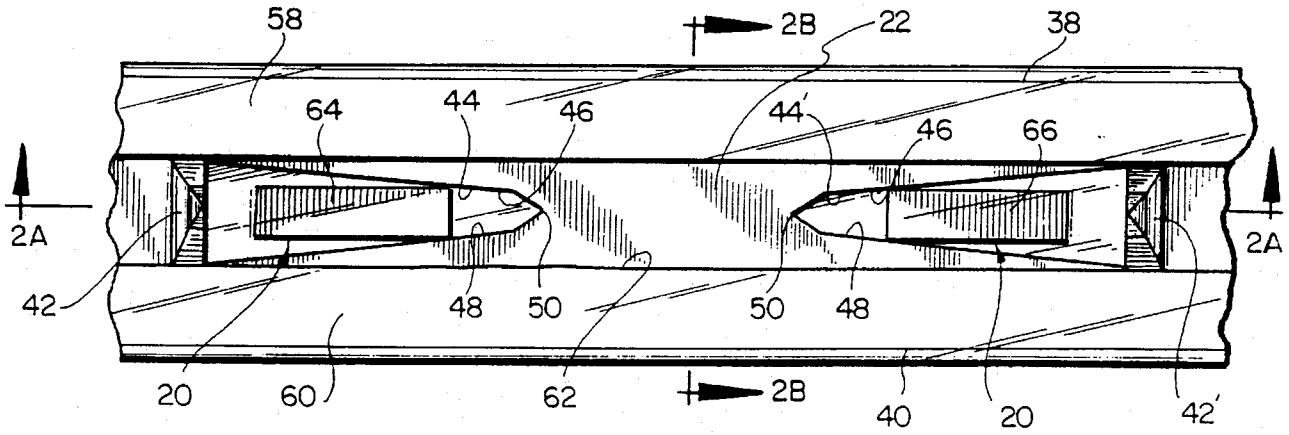
FIG. 2 is a top plan view of the tack strip assembly of FIG. 1.
Figure 2B:
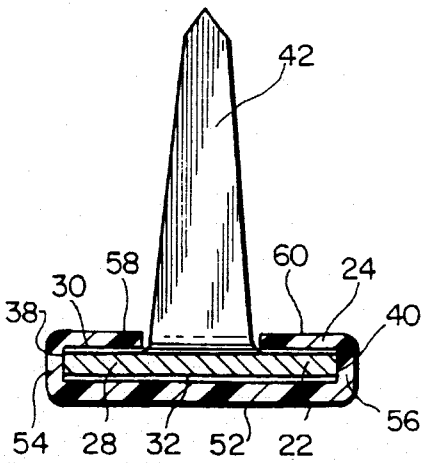
FIG. 2B is a cross sectional view of the tack strip assembly along line 2B—2B in FIG. 2.
Figure 3:
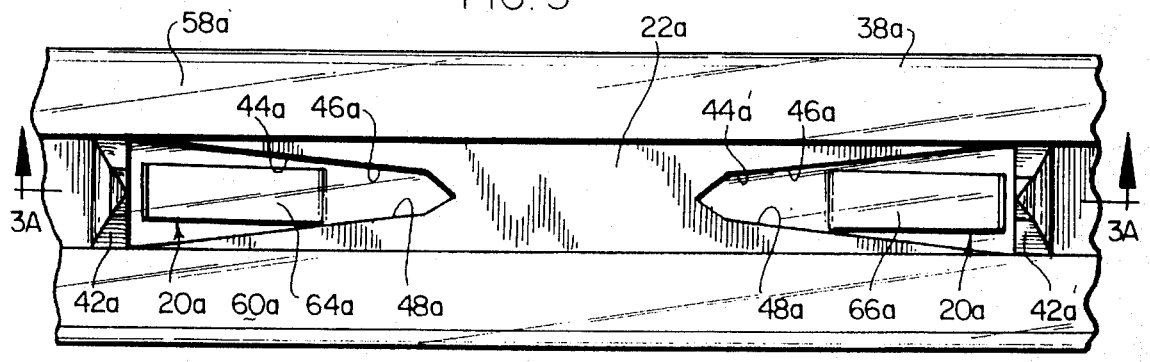
FIG. 3 is a top plan view of a tack strip assembly which incorporates the features of a second embodiment of the invention.
Figure 3A:
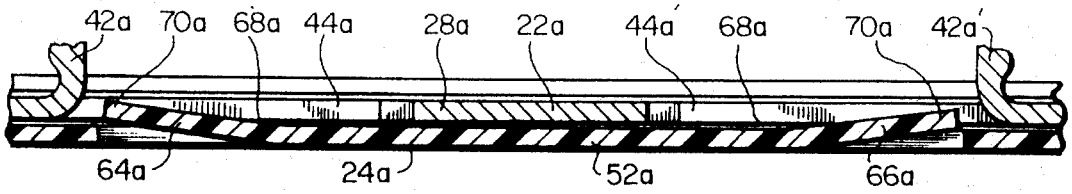
FIG. 3A is a cross sectional view of the second embodiment of the tack strip assembly shown along line 3A—3A in FIG. 3.
Figure 4:
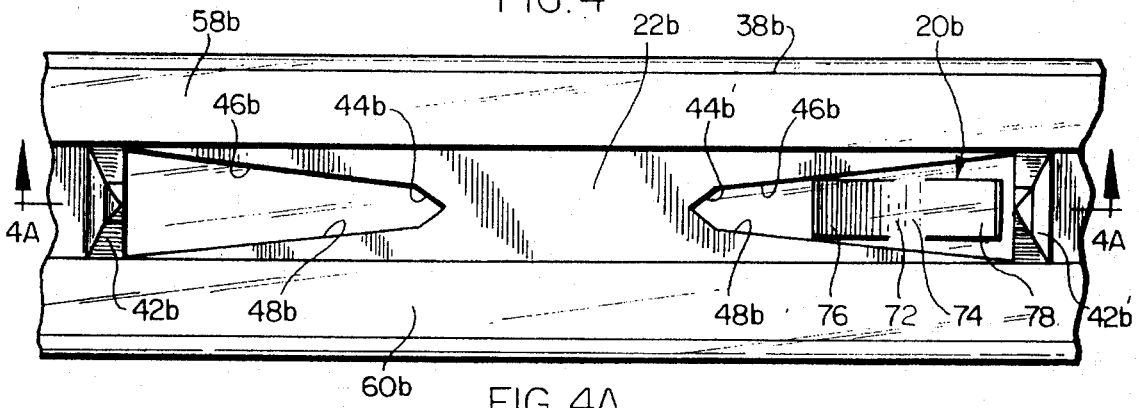
FIG. 4 is a top plan view of a tack strip assembly which incorporates the features of a third embodiment of the invention.
Figure 4A:
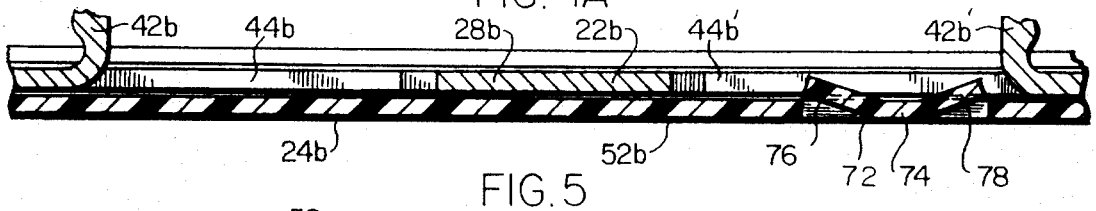
FIG. 4A is a cross sectional view of the third embodiment of the tack strip assembly shown along line 4A—4A in FIG. 4.
Figure 5:
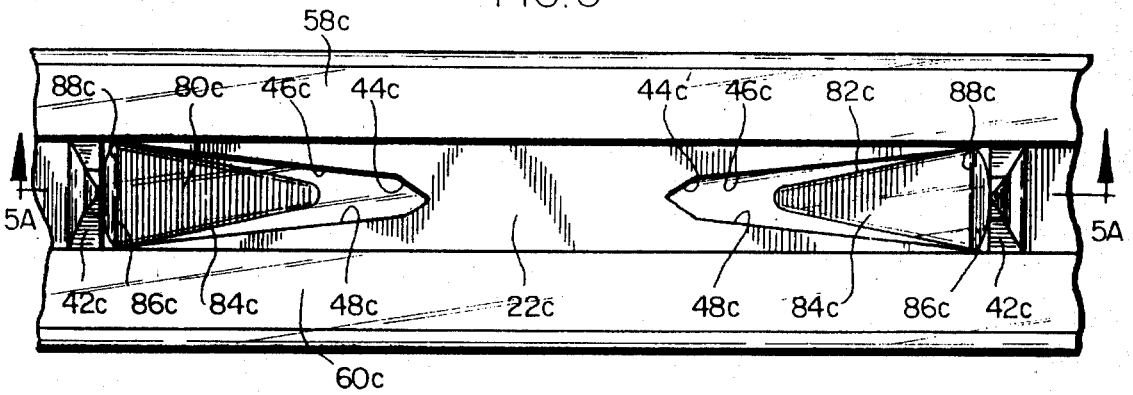
FIG. 5 is a top plan view of a tack strip assembly which incorporates the features of a fourth embodiment of the invention.
Figure 5A:
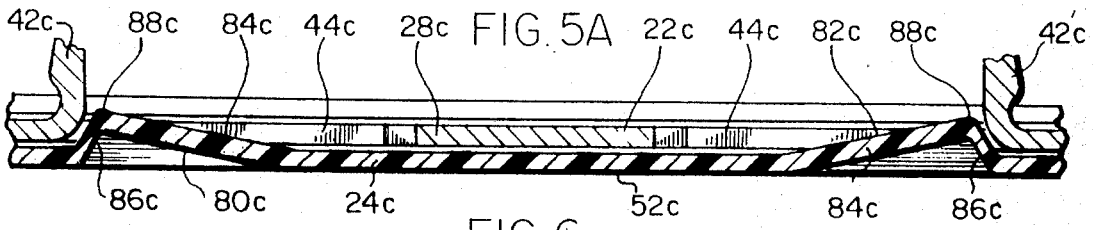
FIG. 5A is a cross sectional view of the fourth embodiment of the tack strip assembly shown along line 5A—5A in FIG. 5.
Figure 6:
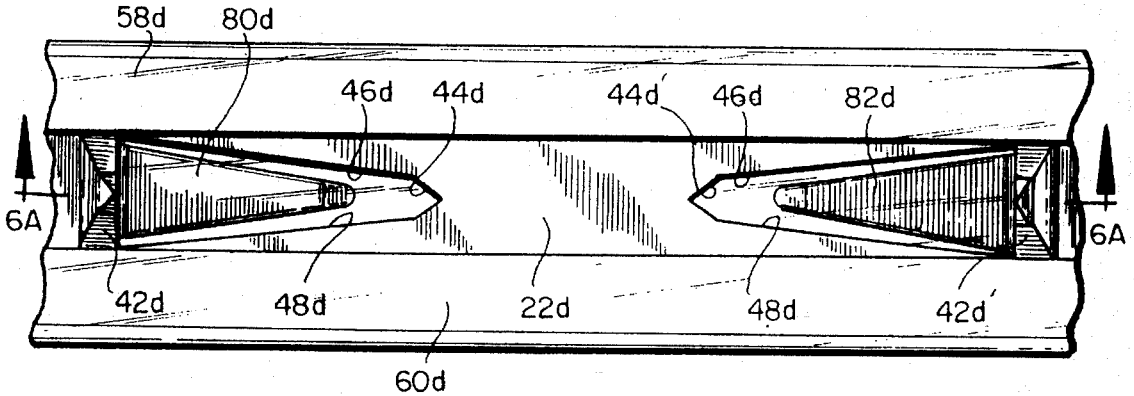
FIG. 6 is a top plan view of a tack strip assembly which incorporates the features of a fifth embodiment of the invention.
Figure 6A:
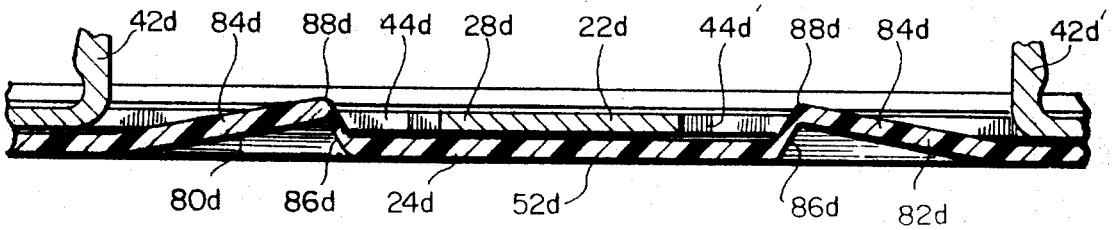
FIG. 6A is a cross sectional view of the fifth embodiment of the tack strip assembly shown along line 6A—6A in FIG. 6.
Figure 7:
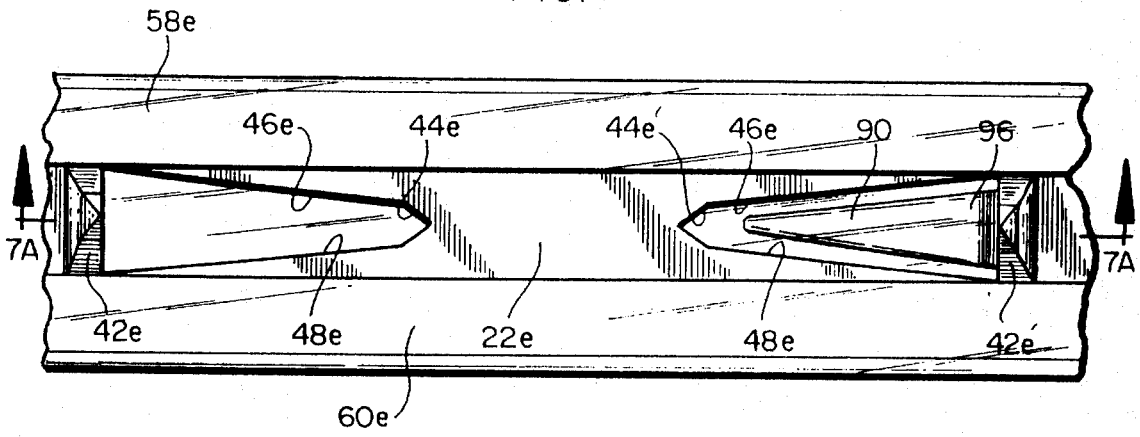
FIG. 7 is a top plan view of a tack strip assembly which incorporates the features of a sixth embodiment of the invention.
Figure 7A:
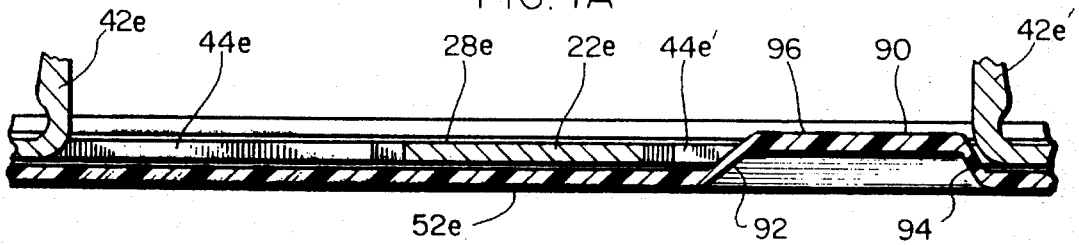
FIG. 7A is a cross sectional view of the sixth embodiment of the tack strip assembly shown along line 7A—7A in FIG. 7.

The present invention includes a novel interlocking means 20 between a tack strip 22 and a protective sleeve 24 in a tack strip assembly 26. A first embodiment of the tack strip assembly is shown in FIGS. 1–2B. A second embodiment of the tack strip assembly is shown in FIGS. 3 and 3A. A third embodiment of the tack strip assembly is shown in FIGS. 4 and 4A. A fourth embodiment of the tack strip assembly is shown in FIGS. 5 and 5A. A fifth embodiment of the tack strip assembly is shown in FIGS. 6 and 6A. A sixth embodiment of the tack strip assembly is shown in FIGS. 7 and 7A. Like elements in each of the embodiments are designated by like reference numerals.

First, a general description of the components of the tack strip assembly is described. For clarity in the description of the components, the general description of the tack strip assembly is described with respect to the first embodiment. Thereafter, the specifics of each of the embodiments are described.

The tack strip 22 includes an elongated, flat base portion 28 having a top surface 30, a bottom surface 32, opposite ends 34, 36 and opposite side edges 38, 40. The side edges 38, 40 are generally straight and the ends 34, 36 may be rounded. The tack strip 22 is formed of a suitable material, such as metal and by suitable, known means, such as by stamping. The ends 34, 36 and side edges 38, 40 of the tack strip 22 have sharp burrs thereon which are formed during the stamping process of the base portion 28.

A plurality of tacks 42 of a predetermined height are formed out of the base portion 28 and extend perpendicular to the base portion 28. The tacks 42 are used to pierce the upholstery fabric on a piece of furniture to hold the fabric in place. The tacks 42 generally align with the centerline of the elongated base portion 28 along an intermediate portion of the base portion 28. As shown best in FIG. 2B, each tack 42 is generally triangular in shape having a base which is integrally formed with the base portion 28 which tapers from the base to a pointed apex or end.

The tacks 42 are formed during the stamping process. To form each tack 42, the outline of the tack 42 is stamped or otherwise struck into the base portion 28 and then the tack 42 is bent until it is generally perpendicular to the base portion 28. Thus, the base of the tack 42 is integral with the base portion 28. Thereafter, the sides of the tack 42 are preferably swaged (not shown) to make the tack 42 thinner, stronger and easier to drive into the wood of a piece of furniture. The pointed ends of each tack 42 may be bent (not shown) by suitable means.

When each tack 42 is formed out of the base portion 28 and bent so as to be perpendicular to the base portion 28, an aperture 44 is formed in the base portion 28 of the tack strip 22 which corresponds in shape to the shape of the tack 42. Thus, the apertures 44 are generally triangular shaped having a base which is proximate to the base of the tack 42 and walls 46, 48 which taper away from the base of the aperture 44 to a point 50. As shown in FIG. 2, the points 50 of adjacent pairs of apertures 44 face each other. The tacks 42 are spaced apart from each other a predetermined distance which is greater than the length of two tacks 42. Thus, the apertures 44 which are formed in the base portion 28 do not connect into each other and are spaced from each other with a continuous portion of the base portion 28 between each of the apertures 44.

To prevent damage to furniture or an operator's fingers due to the metal burrs on the side edges 38, 40 and the ends 34, 36 of the tack strip 22, the strip 22 is inserted into the elongate protective sleeve 24. The sleeve 24 is made of a suitable, flexible, yet somewhat rigid material, such as vinyl or other suitable plastic. The protective sleeve 24 insulates any metal edge at the side edges 38, 40 or the ends 34, 36 of the strip 22.

As shown in FIGS. 1–2B, the sleeve 24 includes a bottom portion 52 which overlays the bottom surface 32 of the base portion 28, side portions 54, 56 which extend around the side edges 38, 40 of the base portion 28 and top portions 58, 60 which overlay substantial portions of the top surface 30 of the base portion 28 of the tack strip 22. A space 62 is provided between the top portions 58, 60 of the sleeve 24 so that the tacks 42 can extend outwardly from the base portion 28 and the strip 22 can be easily inserted into the sleeve 24. The sleeve 24 is longer than the tack strip 22 and extends beyond each end 34, 36 of the tack strip 22. Thus, any burrs which are formed on the side edges 38, 40 or ends 34, 36 of the tack strip 22 are insulated from outside contact by the protective sleeve 24.

Since the base portion 28 is generally enclosed within or surrounded by the protective sleeve 24, the base portion 28 cannot be easily pulled out of the sleeve 24 through the space 62. The base portion 28, however, can slide relative to the sleeve 24 to disengage the tack strip 22 from the sleeve 24. To prevent this, or at least to minimize the possibility of this sliding relative motion, the present invention includes the novel interlocking means 20 between the protective sleeve 24 and the base portion 28 as described herein.

Now that the tack strip assembly 26 has been generally described, the specifics of the novel interlocking means 20–20*e* for each embodiment of the tack strip assembly are described. Each interlocking means 20–20*e* includes at least one tab, as described herein, which is formed into the bottom portion 52 of the sleeve 24 and which extends into one of the apertures 44 in the base portion 28 of the tack strip 22. These novel interlocking means 20–20*e* restrain and minimize the amount of relative endwise movement which can occur between the tack strip 22 and its protective sleeve 24. The interlocking means 20–20*e* also substantially minimizes the possibility of the protective sleeve 24 from detaching from the tack strip 22.

The embodiments of the interlocking means 20–20*b* shown in FIGS. 1–4A use at least one tab. In these embodiments, each tab is cut or otherwise formed in the bottom surface of the protective sleeve by suitable machinery. The embodiments of the interlocking means 20*c*–20*e* shown in FIGS. 5–7A use at least one tab. In these embodiments, each tab is embossed or otherwise formed in the bottom surface of the protective sleeve by suitable machinery by deforming the material of the bottom surface of the protective sleeve.

Figure 2A:
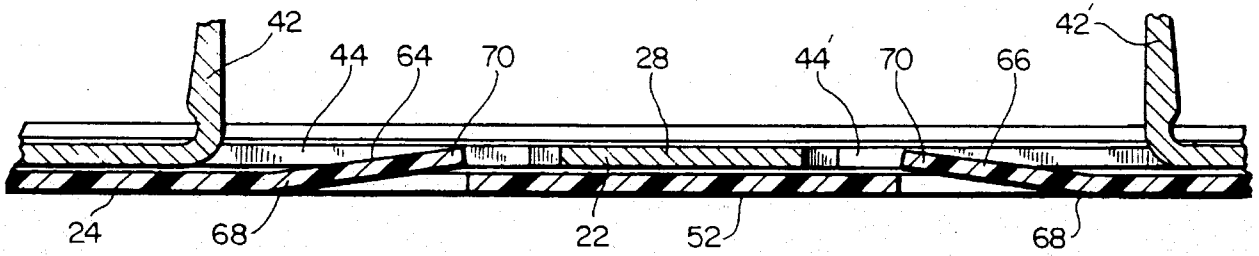
FIG. 2A is a cross sectional view of the first embodiment of the tack strip assembly shown along line 2A—2A in FIG. 2.

Directing attention to the embodiment of the interlocking means 20 shown in FIGS. 2 and 2A, at least two tabs 64, 66 are preferably used in this embodiment. A tab may be provided for each aperture. Each tab 64, 66 has a first end 68 which is integral with the bottom portion 52 of the protective sleeve 24 and a second end 70 which is free and extends into an aperture 44, 44', respectively. Each tab 64, 66 is bent at the first end 68 by suitable means so that the second end 70 extends into the respective aperture 44, 44'. In this embodiment, the first end 68 of each tab 64, 66 is proximate to its respective tack 42, 42' and since the apertures 44, 44' face each other as shown in FIG. 2A, the second free ends 70 of tabs 64, 66 face each other.

Each tab 64, 66 is bent at its first end 68 at an angle such that the top of the second free end 70 of each tab 64, 66 is generally flush with the top surface 30 of the base portion 28. Each second end 70 has a width which is greater than the smallest width of the tapered aperture 44.44'. If the protective sleeve 24 moves towards the base portion's rightmost end (as shown in FIGS. 2 and 2A), the top of the second free end 70 of tab 64 abuts against the tapered walls 46, 48 of the aperture 44 and prevents any further relative endwise movement between the protective sleeve 24 and the base portion 28 and thus, prevents the sleeve 24 from sliding off of or disengaging from the base portion 28. Likewise, if the protective sleeve 24 moves towards the base portion's leftmost end (as shown in FIGS. 2 and 2A), the top of the second free end 70 of tab 66 abuts against the tapered walls 46, 48 of the aperture 44' and prevents any further relative endwise movement between the protective sleeve 24 and the base portion 28 and thus, prevents the sleeve 24 from sliding off of or disengaging from the base portion 28. The vinyl or other suitable plastic material from which the sleeve 24 is formed has sufficient rigidity so that the tabs 64, 66 will not buckle when pushed up against the walls 46, 48 of the apertures 44, 44'.

Directing attention to the embodiment of the interlocking means 20*a* shown in FIGS. 3 and 3A, at least two tabs 64*a*, 66*a* are preferably used in this embodiment. A tab may be provided for each aperture. Each tab 64*a*, 66*a* has a first end 68*a* which is integral with the bottom portion 52*a* of the protective sleeve 24*a* and a second end 70*a* which is free and extends into the aperture 44*a*, 44*a*'. Each tab 64*a*, 66*a* is bent at the first end 68*a* by suitable means so that the second end 70*a* extends into the respective aperture 44*a*, 44*a*'. In this embodiment, the second free end 70*a* of each tab 64*a*, 66*a* is proximate to the tack 42*a*, 42*a*', respectively, and since the apertures 44*a*, 44*a*' face each other as shown in FIG. 3A, the first ends 68*a* of tabs 64*a*, 66*a* face each other. Each tab 64*a*, 66*a* is bent at its first end 68*a* at an angle such that the top of the second free end 70*a* of each tab 64*a*, 66*a* is generally flush with the top surface 30*a* of the base portion 28*a*.

If the protective sleeve 24*a* moves towards the base portion's rightmost end (as shown in FIGS. 3 and 3A), the top of the second free end 70*a* of tab 66*a* abuts against the tack 42*a*' and prevents any further relative endwise movement between the protective sleeve 24*a* and the base portion 28*a* and thus, prevents the sleeve 24*a* from sliding off of or disengaging from the base portion 28*a*. Likewise, if the protective sleeve 24*a* moves towards the base portion's leftmost end (as shown in FIGS. 3 and 3A), the top of the second free end 70*a* of tab 64*a* abuts against the tack 42*a* and prevents any further relative endwise movement between the protective sleeve 24*a* and the base portion 28*a* and thus, prevents the sleeve 24*a* from sliding off of or disengaging from the base portion 28*a*. The vinyl or other suitable plastic material from which the sleeve 24*a* is formed has sufficient rigidity so that the tabs 64*a*, 66*a* will not buckle when pushed up against the tacks 42*a*, 42*a*'.

Directing attention to the embodiment of the interlocking means 20*b* shown in FIGS. 4 and 4A, only a single tab 72 needs to be used in this embodiment, but more than a single tab may be provided. The tab 72 has a middle portion 74 which is integral with the bottom surface 32*b* of the protective sleeve 22*b* and first and second free ends 76, 78 which extend from the middle portion 74 and into the aperture 44*b*'. The tab 72 is bent by suitable means along the middle portion 74 so that the first and second free ends 76, 78 extend into the aperture 44*b*'. The tab 72 is bent at its middle portion 74 at an angle such that the top of each of the first and second free ends 76, 78 are generally flush with the top surface 30*b* of the base portion 28. Each free end 76, 78 of the tab 72 has a width which is greater than the smallest width of the tapered aperture 44*b*'.

If the protective sleeve 24*b* moves towards the base portion's rightmost end (as shown in FIGS. 4 and 4A), the top of the second free end 78 of the tab 72 abuts against the tack 42*b*' and prevents any further relative endwise movement between the protective sleeve 24*b* and the base portion 28*b* and thus, prevents the sleeve 24*b* from sliding off of or disengaging from the base portion 28*b*. Likewise, if the protective sleeve 24*b* moves towards the base portion's leftmost end (as shown in FIGS. 4 and 4A), the top of the first free end 76 of the tab 72 abuts against the tapered walls 4,6*b*, 48*b* of the aperture 44*b*' and prevents any further relative endwise movement between the protective sleeve 24*b* and the base portion 28*b* and thus, prevents the sleeve 24*b* from sliding off of or disengaging from the base portion 28*b*. The vinyl or other suitable plastic material from which the sleeve 24*b* is formed has sufficient rigidity so that the free ends 76, 78 of the tab 72 will not buckle when pushed up against the walls 46*b*, 48*b* of the aperture 44*b*' or against the tack 42*b*'.

Directing attention to the embodiment of the interlocking means 20*c* shown in FIGS. 5 and 5A, at least two tabs 80*c*, 82*c* are preferably used in this embodiment. A tab may be provided for each aperture in the tack strip 22*c*. Each tab 80*c*, 82*c* has a first wall 84*c* and a second wall 86*c*, each of which are integral with the bottom portion 52*c* of the protective sleeve 24*c*. The first wall 84*c* is angled at approximately 45 degrees relative to the bottom portion 52*c* of the protective sleeve 24*c*. The second wall 86*c* extends from the bottom portion 52*c* of the sleeve 24*c* and integrally joins the first wall 84*c* at a shoulder 88*c*. Thus, each tab 80*c*, 82*c* protrudes into its respective aperture 44*c*, 44*c*'. In this embodiment, the second wall 86*c* of each tab 80*c*, 82*c* is proximate to the respective tack 42*c*, 42*c*' and since the apertures 44*c*, 44*c*' face each other as shown in FIG. 5A, the first walls 84*c* of tabs 80*c*, 82*c* face each other. Each tab 80*c*, 82*c* protrudes into the respective aperture 44*c*, 44*c*' such that the top of the shoulder 88*c*, 88*c*' is generally flush with the top surface 30*c* of the base portion 28*c*.

If the protective sleeve 24*c* moves towards the base portion's rightmost end (as shown in FIGS. 5 and 5A), the second wall 86*c* of tab 82*c* abuts against the tack 42*c*' and prevents any further relative endwise movement between the protective sleeve 24*c* and the base portion 28*c* and thus, prevents the sleeve 24*c* from sliding off of or disengaging from the base portion 28*c*. Likewise, if the protective sleeve 24*c* moves towards the base portion's leftmost end (as shown in FIGS. 5 and 5A), the second wall 86*c* of tab 80*c* abuts against the tack 42*c* and prevents any further relative endwise movement between the protective sleeve 24*c* and the base portion 28*c* and thus, prevents the sleeve 24*c* from sliding off of or disengaging from the base portion 28*c*. The vinyl or other suitable plastic material from which the sleeve 24*c* is formed has sufficient rigidity so that the tabs 80*c*, 82*c* will not buckle when pushed up against the tacks 42*c*, 42*c*'.

Directing attention to the embodiment of the interlocking means 20*d* shown in FIGS. 6 and 6A, at least two tabs 80*d*, 82*d* are preferably used in this embodiment. A tab may be provided for each aperture in the tack strip 22*d*. Each tab 80*d*, 82*d* has a first wall 84*d* and a second wall 86*d*, each of which are integral with the bottom portion 52*d* of the protective sleeve 24*d*. The first wall 86*d* is angled at approximately 45 degrees relative to the bottom portion 52*d* of the protective sleeve 24*d*. The first wall 86*d* extends from the bottom portion 52*d* of the sleeve 24*d* and integrally joins the second wall 86*d* at a shoulder 88*d*. Thus, each tab 80*d*, 82*d* protrudes into its respective aperture 44*d*, 44*d*'. In this embodiment, the first wall 84*d* of each tab 80*d*, 82*d* is proximate to its respective tack 42*d*, 42*d*' and since the apertures 44*d*, 44*d*' face each other as shown in FIG. 6A, the second walls 86*d* of tabs 80*d*, 82*d* face each other. Each tab 80*d*, 82*d* protrudes into its respective aperture 44*d*, 44*d*' such that the top of the shoulder 88*d* is generally flush with the top surface 30*d* of the base portion 28*d*.

If the protective sleeve 24*d* moves towards the base portion's rightmost end (as shown in FIGS. 6 and 6A), the second wall 86*d* of tab 80*d* abuts against the tapered walls 46*d*, 48*d* of the aperture 44*d* and prevents any further relative endwise movement between the protective sleeve 24*d* and the base portion 28*d* and thus, prevents the sleeve 24*d* from sliding off of or disengaging from the base portion 28*d*. Likewise, if the protective sleeve 24*d* moves towards the base portion's leftmost end (as shown in FIGS. 6 and 6A), the second wall 86*d* of tab 82*d* abuts against the tapered walls 46*d*, 48*d* of the aperture 44*d*' and prevents any further relative endwise movement between the protective sleeve 24*d* and the base portion 28*d* and thus, prevents the sleeve 24*d* from sliding off of or disengaging from the base portion 28*d*. The vinyl or other suitable plastic material from which the sleeve 24*d* is formed has sufficient rigidity so that the tabs 80*d*, 82*d* will not buckle when pushed up against the walls 46*d*, 48*d* of the apertures 44*d*, 44*d*'.

Directing attention to the embodiment of the interlocking means 20*e* shown in FIGS. 7 and 7A, only a single tab 90 needs to be used in this embodiment, but more than a single tab may be provided. The tab 90 has first and second walls 92, 94 which are integral with the bottom portion 52*e* of the protective sleeve 24*e* and which extend upwardly to a middle portion 96 so that the tab 90 protrudes into the aperture 44*e*'. The first and second walls 92, 94 are angled at approximately 45 degrees relative to the bottom portion 52*e* of the protective sleeve 24*e*. The middle portion 96 is connected to the first and second walls 92, 94 at corners. The middle portion 96 of the tab 90 is generally parallel to the bottom portion 52 of the sleeve 24*e* and is generally flush with the top surface 30*e* of the base portion 28*e*.

If the protective sleeve 24*e* moves towards the base portion's rightmost end (as shown in FIGS. 7 and 7A), the second wall 94 of the tab 90 abuts against the tack 42*e*' and prevents any further relative endwise movement between the protective sleeve 24*e* and the base portion 28*e* and thus, prevents the sleeve 24*e* from sliding off of or disengaging from the base portion 28*e*. Likewise, if the protective sleeve 24*e* moves towards the base portion's leftmost end (as shown in FIGS. 7 and 7A), the first wall 92 of the tab 90 abuts against the tapered walls 46*e*, 48*e* of the aperture 44*e*' and prevents any further relative endwise movement between the protective sleeve 24*e* and the base portion 28*e* and thus, prevents the sleeve 24*e* from sliding off of or disengaging from the base portion 28*e*. The vinyl or other suitable plastic material from which the sleeve 24*e* is formed has sufficient rigidity so that the tab 90 will not buckle when pushed up against the walls 46*e*, 48*e* of the aperture 44*e*' or against the tack 42*e*'.

While the apertures have been described as formed in the base portion and the tab or tabs have been described as formed on the bottom portion of the sleeve, it is to be understood that the apertures can be provided in the bottom surface of the sleeve and the tabs can be formed in the base portion. The embodiments disclosed herein work equally well with this type of arrangement. It is also within the scope of the invention that the apertures do not need to be formed at the base of the tacks. The apertures which interengage with the tabs can be spaced from the tacks.

These novel interlocking means 20–20*e* described herein are substantially cheaper for customers since the possibility of the sleeve and the tack strip becoming dislodged from one another is minimized. Thus, the customer does not need to worry about the tack strip needing to be reinserted into or centered relative to the sleeve. The tack strip and sleeve are also less expensive to produce than the tack strips that use drops of hot melt glue that need to be manually and laboriously placed on each individual strip to bond the tack strip and the protective sleeve together.

While preferred embodiments of the present invention are shown and described, it is envisioned that those skilled in the art may devise various modifications of the present invention without departing from the spirit and scope of the appended claims.

The invention claimed is:

1. A tack strip assembly comprising: an elongate base portion having an upper surface, a lower surface, opposite ends, side edge and a plurality of spaced tacks extending outwardly from said base portion, said base portion having at least one aperture therethrough, said aperture having walls; an elongate sleeve member including a bottom portion which generally overlays the bottom surface of said base portion and side portions which overlay the side edges of the base portion, said bottom portion of said sleeve member having interlocking means integrally formed therein which is interengaged with said at least one aperture in said base portion for restraining relative endwise movement between said sleeve member and said base portion.

2. A tack strip assembly as defined in claim 1, wherein said interlocking means includes means disposed for abutting against one of said tacks.

3. A tack strip assembly as defined in claim 2, wherein said means disposed for abutting against one of said tacks comprises a tab having a free end extending from said bottom portion of said sleeve member and into said aperture in said base portion.

4. A tack strip assembly as defined in claim 2, wherein said means disposed for abutting against one of said tacks comprises a tab having opposite ends integral with said bottom portion and extending from said bottom portion of said sleeve member and into said aperture in said base portion.

5. A tack strip assembly as defined in claim 1, wherein said interlocking means includes means disposed for abutting against at least of one said walls of said aperture.

6. A tack strip assembly as defined in claim 5, wherein said means disposed for abutting against said at least one of said walls comprises a tab extending from said bottom portion of said sleeve member and into said aperture in said base portion.

7. A tack strip assembly as defined in claim 5, wherein said means disposed for abutting against said at least one of said walls comprises an embossed tab protruding from said bottom portion of said sleeve member and into said aperture in said base portion.

8. A tack strip assembly as defined in claim 1, wherein said interlocking means comprises a tab which extends into said aperture in said base portion.

9. A tack strip assembly as defined in claim 8, wherein said tab has a first end which is integral with the bottom portion of said sleeve member and a second end which is free and extends into said aperture.

10. A tack strip assembly as defined in claim 8, wherein said tab has a middle portion which is integral with said bottom portion of said sleeve member and first and second free ends which extend from said middle portion and into said aperture.

11. A tack strip assembly as defined in claim 8, wherein said tab has a first and second walls which are integral with the bottom portion of said sleeve member, said first and second walls extending into said aperture.

12. A tack strip assembly comprising: a tack strip including an elongate base portion and a plurality of spaced tacks struck from and extending from said base portion, said base portion having a plurality of apertures therethrough formed by struck out material providing said tacks, said base portion having a bottom surface, a top surface and opposite side edges; a sleeve having a bottom portion overlaying said bottom surface of said base portion and side portions which overlay the side edges of the base portion, said sleeve having at least one raised tab means integrally formed with said bottom portion, said tab means including portions projecting in opposite directions and extending into said at least one aperture of said tack strip thereby restraining relative endwise movement in opposite directions between said sleeve member and said tack strip.

13. A tack strip assembly as defined in claim 12, said sleeve having top portions which overlay portions of said top surface of said base portion of said tack strip.

14. A tack strip assembly as defined in claim 1, said sleeve having top portions which overlay portions of said upper surface of said base portion of said tack strip.

15. A tack strip assembly as defined in claim 12, wherein said tab means portions are disposed substantially entirely within said top surface of said base portion.

* * * * *